US006903715B2

(12) United States Patent
Song

(10) Patent No.: US 6,903,715 B2
(45) Date of Patent: Jun. 7, 2005

(54) LIQUID CRYSTAL DISPLAY AND DRIVING APPARATUS THEREOF

(75) Inventor: Hong Sung Song, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 207 days.

(21) Appl. No.: 10/029,202

(22) Filed: Dec. 28, 2001

(65) Prior Publication Data

US 2002/0190937 A1 Dec. 19, 2002

(30) Foreign Application Priority Data

May 22, 2001 (KR) ..... P2001-27891

(51) Int. Cl.[7] ..... G09G 3/36
(52) U.S. Cl. ..... 345/94; 345/99; 345/100
(58) Field of Search ..... 345/87, 94, 95, 345/98, 99, 100, 204, 208, 210

(56) References Cited

U.S. PATENT DOCUMENTS 4,651,148 A * 3/1987 Takeda et al. ..... 345/92
5,526,012 A * 6/1996 Shibahara ..... 345/92
5,745,089 A * 4/1998 Taguchi et al. ..... 345/89

* cited by examiner

*Primary Examiner*—Regina Liang
(74) *Attorney, Agent, or Firm*—Morgan Lewis & Bockius LLP

(57) ABSTRACT

A liquid crystal display device includes a liquid crystal display panel for displaying image data corresponding to a digital video signal, a digital video card for generating the digital video signal, a vertical synchronizing signal and a horizontal synchronizing signal, a controller for generating a dot clock signal and a dual gate start pulse using the vertical and horizontal synchronizing signals, a data driver for applying the digital video signal to data lines in response to the dot clock signal, and a gate driver for applying scanning signals having at least two signal voltage levels to gate lines in response to the dual gate start pulse.

20 Claims, 10 Drawing Sheets

LIQUID CRYSTAL DISPLAY AND DRIVING APPARATUS THEREOF

The present invention claims the benefit of Korean Patent Application No. P2001-27891 filed in Korea on May 22, 2001, which is hereby incorporated by reference.

BACKGROUND OF THE INVENTION

1. Field of the Invention

This invention relates to a liquid crystal display, and more particularly to a liquid crystal display and a driving apparatus thereof that are adaptive for eliminating a flicker caused by a pre-stage gate voltage as well as reducing power consumption.

2. Description of the Related Art

Generally, a liquid crystal display (LCD) controls light transmittance of a liquid crystal cell in accordance with a video signal, thereby displaying image data (picture). For dynamically displaying image data (moving pictures), an active matrix LCD is provided with a switching device for each liquid crystal cell. The active matrix LCD generally uses a thin film transistor (TFT) as the switching device.

FIG. 1 is a block diagram showing a configuration of a conventional liquid crystal display. In FIG. 1, a driving apparatus for an LCD includes a digital video card 1 for converting an analog image signal into a digital video data, a data driver 3 for applying the digital video data to data lines DL of a liquid crystal display panel 6, a gate driver 5 for sequentially driving gate lines GL of the liquid crystal panel 6, and a controller 2 for controlling the data driver 3 and the gate driver 5.

In the liquid crystal panel 6, a liquid crystal material is injected between two glass substrates, and the gate and data lines GL and DL are orthogonally formed on the lower glass substrate. A thin film transistor (TFT) is formed at each intersection between the gate and data lines GL and DL for selectively applying an image inputted from the data lines DL to a liquid crystal cell Clc. The TFT has a drain terminal connected to the gate line GL and a source terminal connected to the data line DL. The drain terminal of the TFT is connected to a pixel electrode of the liquid crystal cell Clc.

The digital video card 1 converts an analog input image signal into a digital image signal suitable for the liquid crystal panel 6 and detects a synchronous signal included in the image signal. The controller 2 applies red (R), green (G) and blue (B) digital video data from the digital video card 1 to the data driver 3. In addition, the controller 2 generates a dot clock signal Dclk and a gate start pulse Gsp using horizontal/vertical synchronizing signals H and V inputted from the digital video card 1, thereby providing a timing control of the data driver 3 and the gate driver 5. The dot clock signal Dclk is applied to the data driver 3, while the gate start pulse Gsp is applied to the gate driver 5. The vertical synchronizing signal V has a frequency of 60 Hz and is created by a vertical synchronizing signal oscillator (not shown) provided at the digital video card 1. The vertical synchronizing signal V indicates a frame end of each field. On the other hand, the horizontal synchronizing signal H indicates an end of each line within a field and is created by a horizontal synchronizing signal (not shown) as given by the following equation:

$$H=VR*RR_v*1.05. \quad (1)$$

where H is the horizontal synchronizing signal, VR is the vertical resolution, and $RR_v$ is the refresh rate of the vertical synchronizing signal V.

FIG. 2 is a detailed block diagram of the gate driver shown in FIG. 1. In FIG. 2, the gate driver 5 includes a shift register 12 for responding to the gate start pulse Gsp inputted from the controller 2 to sequentially generate a scanning pulse, and a level shifter 14 for shifting a voltage of the scanning pulse into a voltage level suitable for a driving of the liquid crystal cell Clc. Video data at the data line DL is applied to a pixel electrode of the liquid crystal cell Clc by the TFT in response to the scanning pulse inputted from the gate driver 5.

The dot clock signal Dclk, along with the R, G and B digital video data from the controller 2, is inputted to the data driver 3. The data driver 3 latches the R, G and B digital video data in synchronization with the dot clock signal Dclk and corrects the latched data in accordance with a gamma voltage Vγ. Then, the data driver 3 converts data corrected by the gamma voltage Vγ into analog data and supplies the analog data to each data line DL.

FIG. 3 is an equivalent circuit diagram of a pixel having a storage-on-gate (SOG) structure shown in FIG. 1. In FIG. 3, the liquid crystal display panel 6 (in FIG. 1) includes a pixel electrode 16, and a TFT T1 arranged at each intersection between the gate and data lines GL and DL to function as a switching device. The pixel electrode 16 is an area for transmitting and extinguishing light that applies a signal voltage to a liquid crystal layer (not shown) to display a picture.

The TFT T1 functions as a switch to load and break a signal voltage to and from a pixel electrode 14 (in FIG. 1). A gate terminal of the TFT T1 is connected to the gate line GL and a drain terminal of the TFT T1 is connected to the pixel electrode 14 (in FIG. 1). Accordingly, the TFT T1 applied a pixel voltage to the pixel electrode 16 to display a picture. An auxiliary capacitor, i.e., a storage capacitor Cst, is used to improve a sustaining characteristic of a liquid crystal application voltage, stabilize a gray scale display, and maintain pixel information during a non-selection interval of a pixel.

The shift register (not shown) of the data driver 3 sequentially receives video signals for each data line DL to store video signals. Subsequently, the gate driver 5 outputs a gate line selection signal GL to sequentially select one gate line of a plurality of the gate lines GL. A plurality of TFT's T1 connected to the selected gate line GL are turned on to apply video signals stored in the shift register of the data driver 8 to the source terminals of the TFT's T1, thereby displaying the video signals on the liquid crystal display panel 6. Thereafter, this operation is repeated to display the video signals on the liquid crystal display panel. The storage capacitor Cst charges data voltage from a pre-stage gate line GLn−1 upon scanning of the gate line GLn.

FIGS. 4 and 5 are waveform diagrams illustrating a time-based change with respect to data voltage charged in the storage capacitor Cst. In FIG. 4, the storage capacitor Cst charges a positive(+) voltage during a 1H interval at which a scanning pulse has an ON state. The voltage charged in the storage capacitor Cst is sustained during one frame after a scanning pulse is turned OFF. In FIG. 5, the storage capacitor Cst charges a negative(−) voltage during a 1H interval at which a scanning pulse has an ON state. The voltage charged in the storage capacitor Cst is sustained during one frame after a scanning pulse is turned ON.

However, a conventional driving method for an LCD employing the storage capacitor Cst is problematic in that a deriving voltage allowing a high voltage of the pre-stage gate line GLn−1 to be derived into the storage capacitor Cst upon data charging of the storage capacitor Cst into the gate line GLn is added to a pixel voltage. Such a deriving voltage will be described in detail through simulation values of FIGS. 6 and 7. In FIGS. 6 and 7, when a gate voltage is 20V, the deriving voltage ΔV having a very high value of about 10V is applied to the pixel. Input signal values of FIGS. 6 and 7 are given by the following table:

TABLE 1

| | |
|---|---|
| Gate Pulse Width | 14.3 μs |
| Gate High Voltage(Vgh) | 21.4 V |
| Gate Low Voltage(Vgl) | −5 V |
| 1 Horizontal Sync. Interval | 15.2 μs |
| Data High Voltage(Vdh) | 5.24 V |
| Data Low Voltage(Vdl) | 1.56 V |
| Common Voltage Data Low Voltage | 2.79 V |

Accordingly, since a voltage Vpixel applied to the pixel has a value in which the deriving voltage ΔV is added to the charged voltage, display data is distorted. The deriving voltage ΔV applied to the pixel has a value three times larger than a voltage applied to a normal pixel, thereby causing sudden liquid crystal displacement. The sudden liquid crystal displacement results from a rising time given by the following equation:

$$\text{Rising Time}(\tau_{on}) \propto r_1 d^2/\epsilon_0 \Delta\epsilon (V^2 - Vth^2) \quad (2)$$

In equation (2), when there is an affect of the pre-stage gate line GLn−1, Vth=1.0V and ΔV=10V.

The following equation represents a variation in rising time according to an affect of the pre-stage gate line GLn−1, when the charged voltage is 5V:

$$\text{Rising Time}(\tau_{on}) \propto r_1 d^2/\epsilon_0 \Delta\epsilon (15.0^{2-}1.0^2) \quad (3)$$

As described above, owing to an affect of the pre-stage gate line GLn−1, the pixel voltage Vpixel becomes a sum of the charged voltage and the deriving voltage ΔV, which is equal to 15V. Since a liquid crystal response speed is inversely proportional to a square of the pixel voltage Vpixel, the rising time significantly increases. If the rising time increases too quickly due to an affect of the pre-stage gate line GLn−1, then liquid crystal displacement occurs. Since the rising time is inversely proportional to a square of an applied voltage, sudden liquid crystal displacement causes a brightness change for each frame to generate a flicker phenomenon, as shown in FIG. 8.

Alternatively, by locating the storage capacitor Cst at an area other than the pre-stage gate line GLn−1, an affect of the pre-stage gate line GLn−1 can be eliminated. For example, a storage-common-gate (SCG) structure in which the storage capacitor Cst is connected to a common electrode line SCL is shown in FIG. 9. However, a storage-capacitor-gate (SCG) structure is disadvantagous in that a pixel aperture ratio is reduced by 5% as compared to the storage-on-gate (SOG) structure. In addition, a total number of processes for forming the storage capacitor Cst increases.

SUMMARY OF THE INVENTION

Accordingly, the present invention is directed to a liquid crystal display and a driving apparatus thereof that substantially obviates one or more of the problems due to limitations and disadvantages of the related art.

An object of the present invention is to provide a liquid crystal display and a driving apparatus that eliminate flicker caused by a pre-stage gate voltage and reduce power consumption.

Another object of the present invention is to provide a liquid crystal display and a driving apparatus having improved picture quality.

Additional features and advantages of the invention will be set forth in the description which follows, and in part will be apparent from the description, or may be learned by practice of the invention. The objectives and other advantages of the invention will realized and attained by the structure particularly pointed out in the written description and claims hereof as well as the appended drawings.

To achieve these and other advantages of the invention and in accordance with the purpose of the present invention, as embodied and broadly described, a liquid crystal display device includes a liquid crystal display panel for displaying image data corresponding to a digital video signal, a digital video card for generating the digital video signal, a vertical synchronizing signal and a horizontal synchronizing signal, a controller for generating a dot clock signal and a dual gate start pulse using the vertical and horizontal synchronizing signals, a data driver for applying the digital video signal to data lines in response to the dot clock signal, and a gate driver for applying scanning signals having at least two signal voltage levels to gate lines in response to the dual gate start pulse.

In another aspect, a method of driving a liquid crystal display including a gate driver for sequentially driving gate lines of the liquid crystal display includes sequentially generating a scanning pulse in response to a dual gate start pulse, shifting a voltage level of the scanning pulse to a voltage level for driving the liquid crystal cell, sequentially applying the shifted voltage level of the scanning pulse to the gate lines, and charging a pixel of the liquid crystal display with the voltage applied to the gate lines via a storage capacitor.

In another aspect, a method of driving a liquid crystal display includes generating a scanning pulse in response to a dual gate start pulse, shifting a voltage level of the scanning pulse to a voltage level for driving a liquid crystal cell, applying the shifted voltage level of the scanning pulse to a plurality of gate lines, and charging a pixel of the liquid crystal display to the applied shifted voltage level via a storage capacitor.

In another aspect, a method of driving a liquid crystal display includes generating a scanning pulse, shifting a voltage level of the scanning pulse to drive a liquid crystal cell, applying the shifted voltage level of the scanning pulse to a plurality of gate lines, and applying the applied shifted voltage level to a pixel via a storage capacitor, wherein a voltage level of the scanning pulse during a second horizontal period signal is larger than a voltage level of the scanning pulse during a first horizontal period signal.

In another aspect, a method of driving a liquid crystal display device includes generating a digital video signal, a vertical synchronizing signal and a horizontal synchronizing signal, generating a dot clock signal and a dual gate start pulse using the vertical and horizontal synchronizing signals, applying the digital video signal to at least a plurality of data lines in response to the dot clock signal, and applying scanning signals having at least two signal voltage levels to at least a plurality of gate lines in response to the dual gate start pulse.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are intended to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Figure 10:
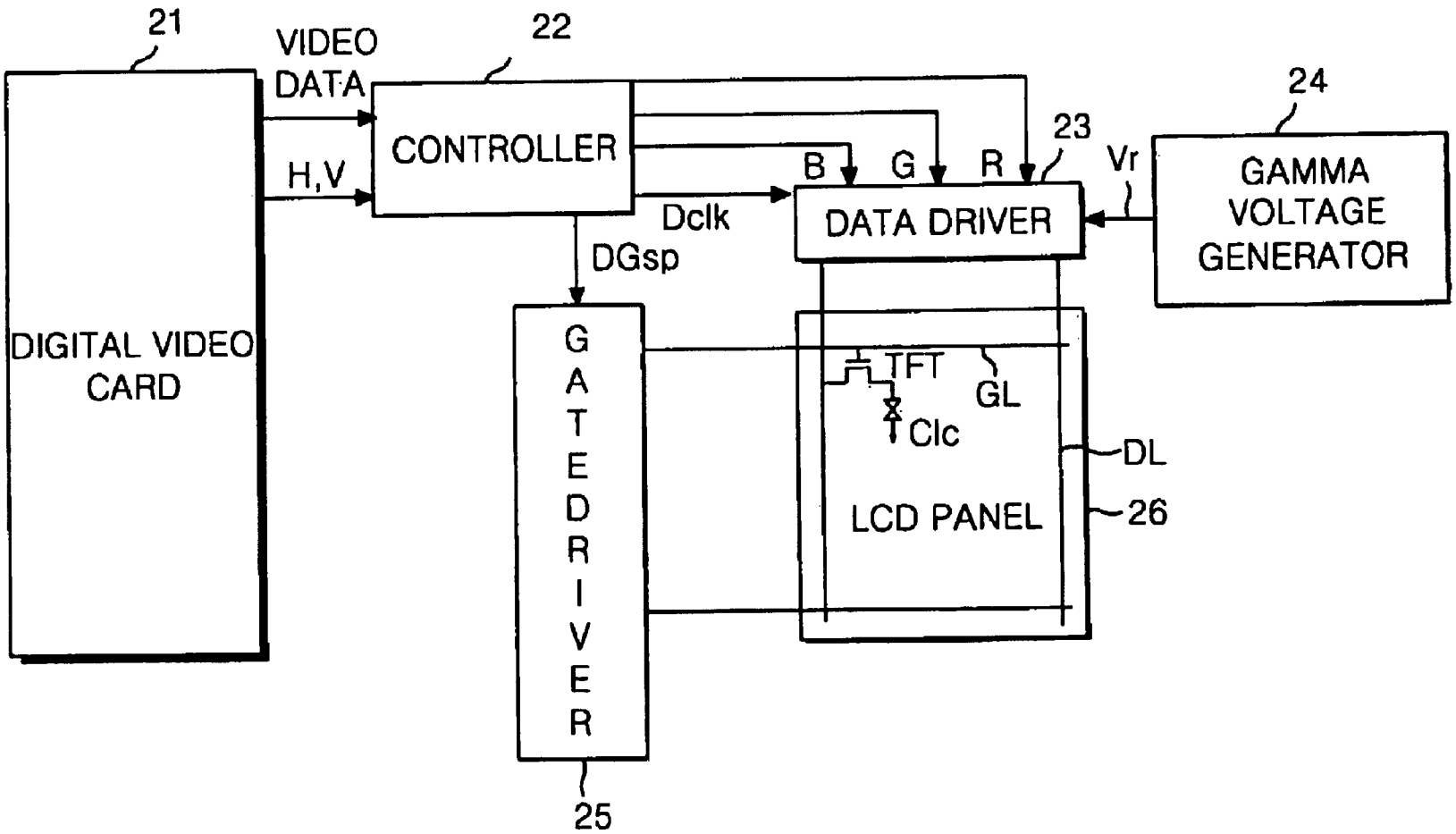
FIG. 10 is a block diagram showing an exemplary liquid crystal display according to the present invention.

FIG. 10 is a block diagram showing an exemplary liquid crystal display according to the present invention. In FIG. 10, a driving apparatus for the LCD includes a digital video card 21 for converting input image signal into digital video data, a data driver 23 for applying the digital video data to data lines DL of a liquid crystal display panel 26, a gate driver 25 for sequentially driving gate lines GL of the liquid crystal panel 26, and a controller 22 for controlling the data driver 23 and the gate driver 25.

In the liquid crystal panel 26, liquid crystal material may be injected between two glass substrates, and the gate and data lines GL and DL may be formed on the lower glass substrate orthogonal to each other. A thin film transistor (TFT) may be provided at each intersection between the gate and data lines GL and DL for selectively applying image data inputted from the data lines DL to a liquid crystal cell Clc. The TFT may have a source terminal connected to the data line DL, a drain terminal connected to both the gate line GL and to a pixel electrode of the liquid crystal cell Clc.

The digital video card 21 converts an analog input image signal into a digital image signal for the liquid crystal panel 26, and detects a synchronous signal included in the digital image signal. The controller 22 applies red (R), green (G), and blue (B) digital video data from the digital video card 21 to the data driver 23. In addition, the controller 22 generates a dot clock signal Dclk and a gate start pulse Gsp using horizontal/vertical synchronizing signals H and V inputted from the digital video card 21 to generate a dot clock Dclk, and a dual gate start pulse DGsp, thereby providing a timing control of the data driver 23 and the gate driver 25. The dot clock signal Dclk may be applied to the data driver 23 while the dual gate start pulse DGsp may be applied to the gate driver 25.

The dot clock signal Dclk, along with the R, G and B digital video data from the controller 22, may be inputted to the data driver 23. The data driver 23 latches the R, G and B digital video data in synchronization with the dot clock signal Dclk and corrects the latched data in accordance with a gamma voltage Vγ. Then, the data driver 23 converts the data corrected by the gamma voltage Vγ into analog data and supplies it to each of the data lines DL.

Figure 11:
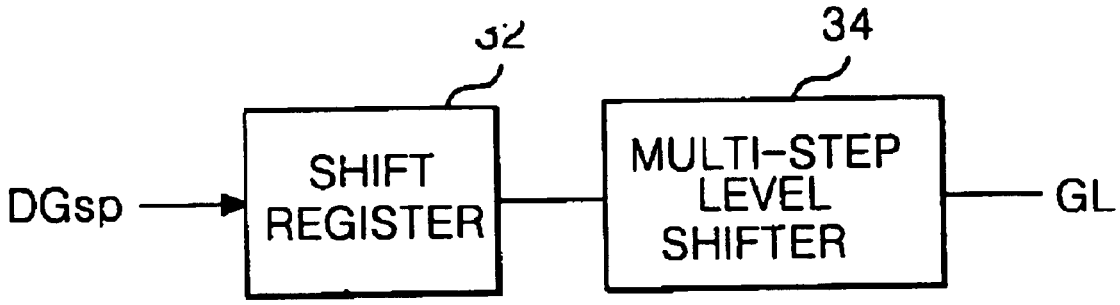
FIG. 11 is a detailed block diagram of the gate driver shown in FIG. 10.

FIG. 11 is a detailed block diagram of the gate driver shown in FIG. 10. In FIG. 11, the gate driver 25 may include a shift register 32 for responding to the dual gate start pulse DGsp inputted from the controller 22 to sequentially generate a scanning pulse, and a level shifter 34 for shifting a voltage of the scanning pulse into a voltage level suitable for driving the liquid crystal cell Clc. Video data at the data line DL is applied to a pixel electrode of the liquid crystal cell Clc by the TFT in response to the scanning pulse inputted from the gate driver 25 (in FIG. 10). Moreover, the TFT allows a data signal on the data line DL to be transferred to the liquid crystal cell Clc and the storage capacitor (not shown) when the gate line GL is enabled. Then, the liquid crystal cell Clc charges a data signal inputted, via the TFT, from the data line DL and controls transmission of light in accordance with a voltage level of the charged data signal.

The dual gate start pulse DGsp inputted from the controller 22 may have a shape profile of a dual pulse or a twice pulse width. If the dual gate start pulse DGsp is inputted, then the level shifter 34 allows a scanning pulse voltage level suitable for driving the liquid crystal cell Clc, and is switched such that a two-level scanning pulse is outputted during two consecutive horizontal synchronizing intervals 2H. Accordingly, the gate driver 25 may sequentially enable n-number of gate lines GL1 to GLn on the liquid crystal display panel 26 for each of the two consecutive horizontal synchronizing intervals 2H, thereby sequentially driving the TFT's on the liquid crystal display panel 26. The two-level scanning pulse may apply two pulses successively or may apply a single pulse at twice the pulse width to be controlled by the level shifter 34 with the gate driver 25.

Figure 1:
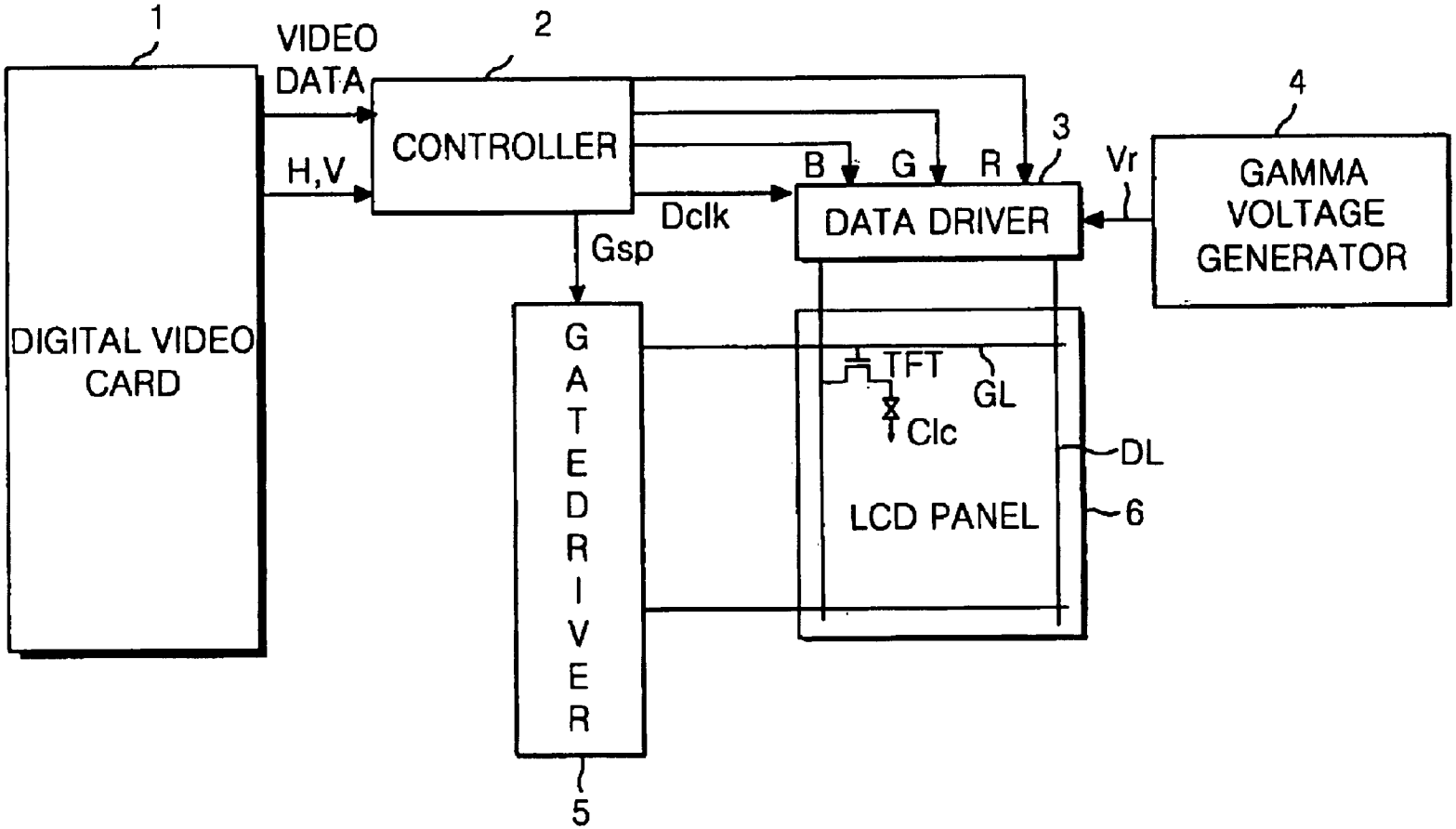
FIG. 1 CONVENTIONAL ART
FIG. 1 is a block diagram showing a conventional liquid crystal display according to a conventional art.
Figure 2:
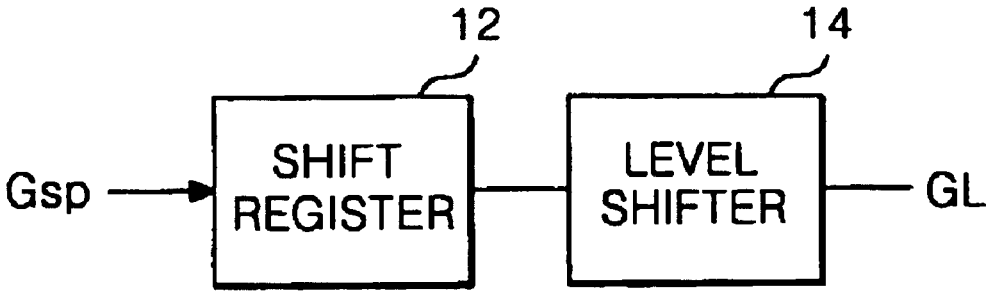
FIG.2 CONVENTIONAL ART
FIG. 2 is a detailed block diagram of the gate driver shown in FIG. 1.
Figure 3:
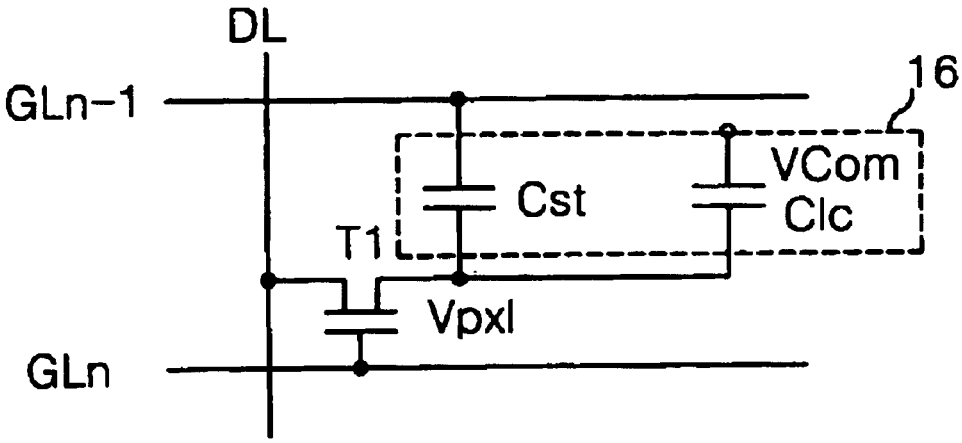
FIG.3 CONVENTIONAL ART
FIG. 3 is an equivalent circuit diagram of the pixel shown in FIG. 1.
Figure 4:
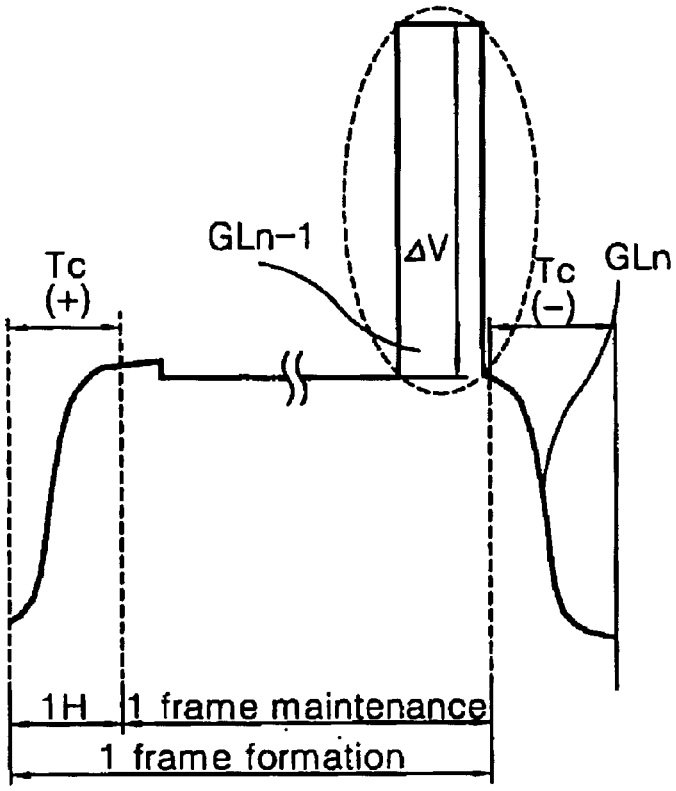
FIG. 4 CONVENTIONAL ART
FIGS. 4 and 5 are waveform diagrams representing a time-based variation of a pixel voltage according to an affect of a pre-stage gate of the conventional art.
Figure 5:
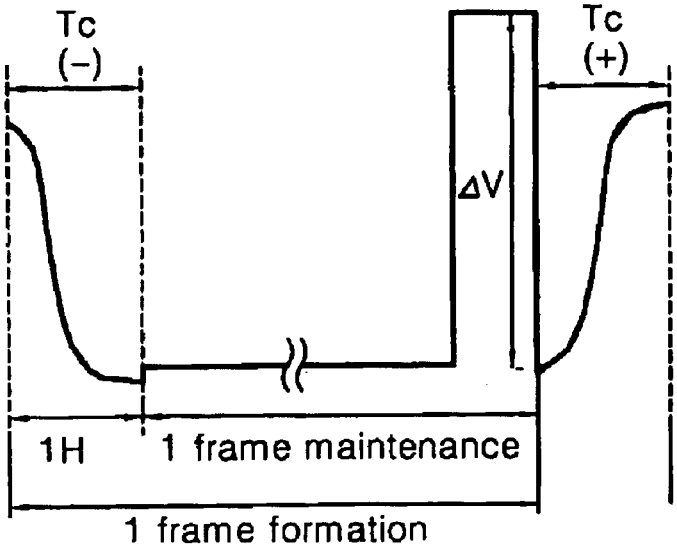
FIG. 5 CONVENTIONAL ART
Figure 6:
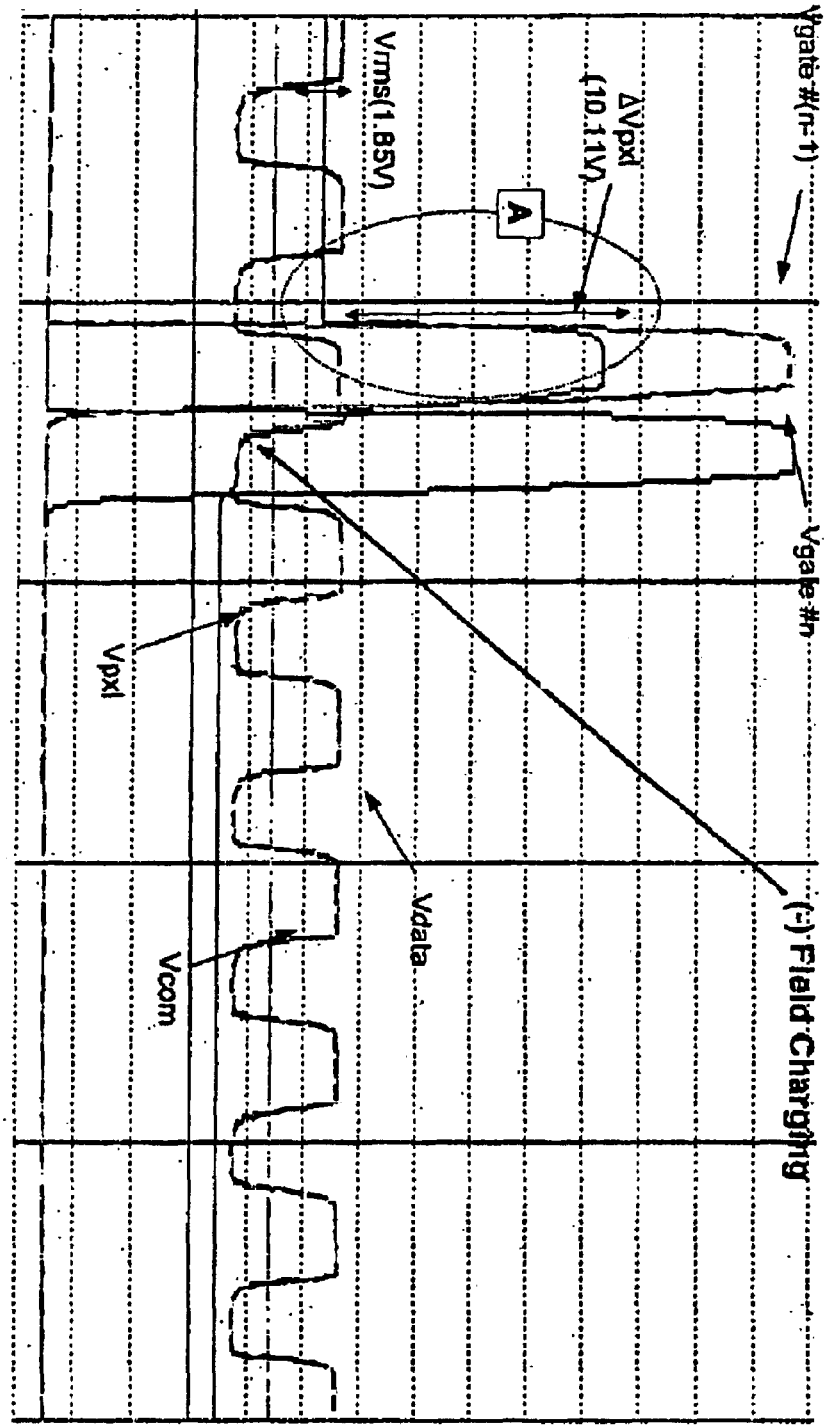
FIG. 6 CONVENTIONAL ART
FIGS. 6 and 7 show simulations on an affect of the pre-stage gate voltage of the waveform diagrams of FIGS. 4 and 5.
Figure 7:
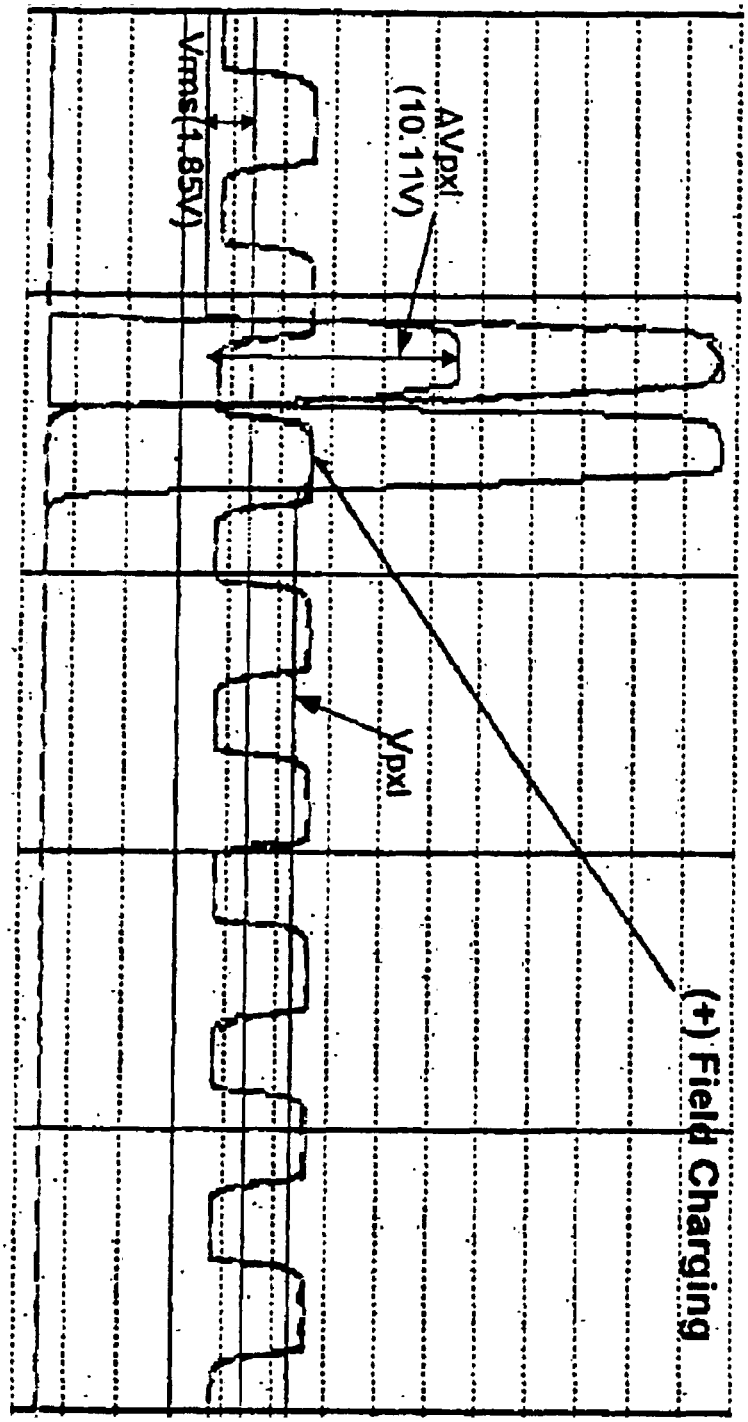
FIG. 7 CONVENTIONAL ART
Figure 8:
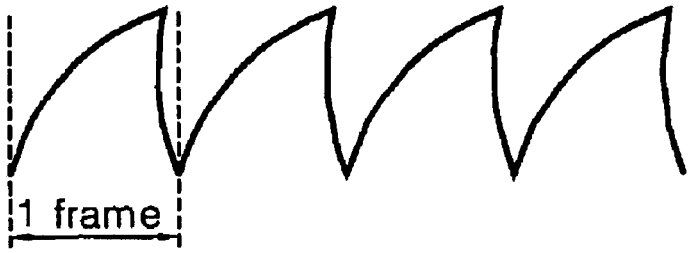
FIG. 8 CONVENTIONAL ART
FIG. 8 is a waveform diagram showing a brightness variation of the pixel according to the conventional art.
Figure 9:
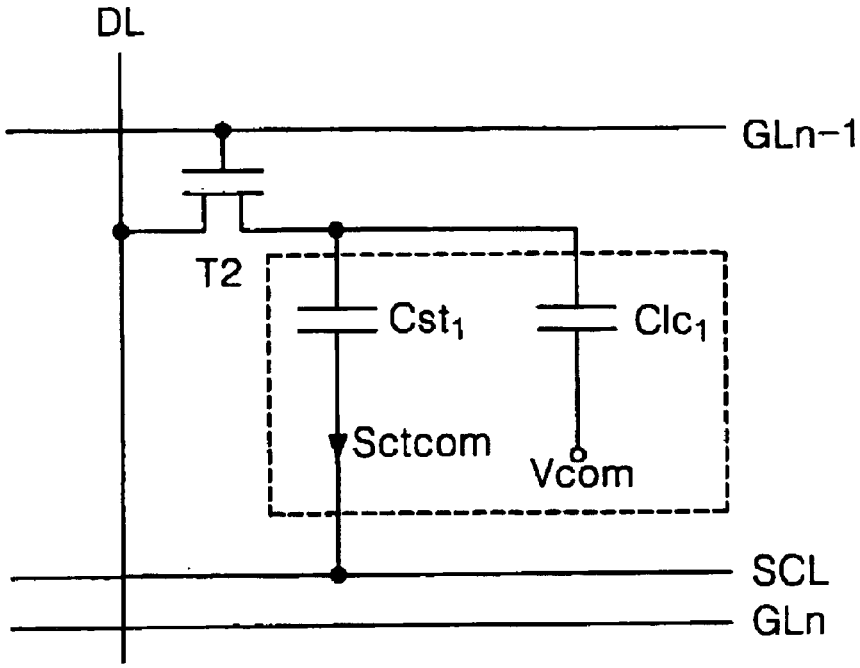
FIG. 9 CONVENTIONAL ART
FIG. 9 is an equivalent circuit diagram of a pixel having a storage-common-gate (SCG) structure according to the conventional art.

The LCD may also have a pixel of storage-on-gate (SOG) structure that may be represented by the equivalent circuit diagram of FIG. 3. Specifically, the liquid crystal display panel 26 may include a pixel electrode 16, and a TFT T1 arranged at each intersection between the gate lines GL and the data lines DL to serve as a switching device. The pixel electrode 16 is disposed in an area for transmitting and extinguishing light that applies a signal voltage to a liquid crystal layer (not shown) to display image data (a picture). The TFT T1 acts as a switch that applies a signal voltage to a pixel electrode 16. A gate terminal of the TFT may be connected to the gate line GL while a drain terminal of the TFT may be connected to the pixel electrode 14. According to a switching operation of the TFT T1, a pixel voltage may be applied to the pixel electrode 16 to display a picture. A storage capacitor Cst may be used to improve sustaining characteristics of a liquid crystal application voltage, thereby stabilizing a gray scale display and maintaining pixel information during a non-selection interval of a pixel.

The shift register (not shown) of the data driver 23 may sequentially receive video signals for each pixel to store video signals corresponding to the data lines DL. Subsequently, the gate driver 25 may output a gate line selection signal GL to sequentially select one gate line of the plurality of gate lines GL. A plurality of TFT's T1 connected to the selected gate line GL are turned ON to apply the video signals stored in the shift register of the data driver 23 to the source terminals of the TFT's T1, thereby displaying the video signals on the liquid crystal display panel 26. Thereafter, the operation is repeated to display the video signals on the liquid crystal display panel. In this case, the storage capacitor Cst charges data voltage from the pre-stage gate line GLn−1 upon scanning of the gate line GLn.

Figure 12:
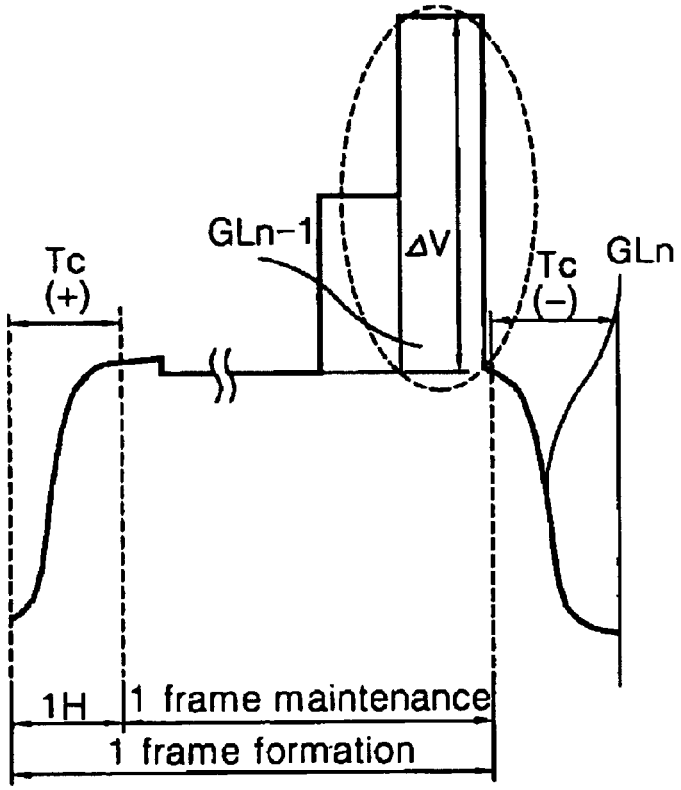
FIGS. 12 and 13 are waveform diagrams representing a time-based variation of a pixel voltage according to an affect of a pre-stage gate according to the present invention.
Figure 13:
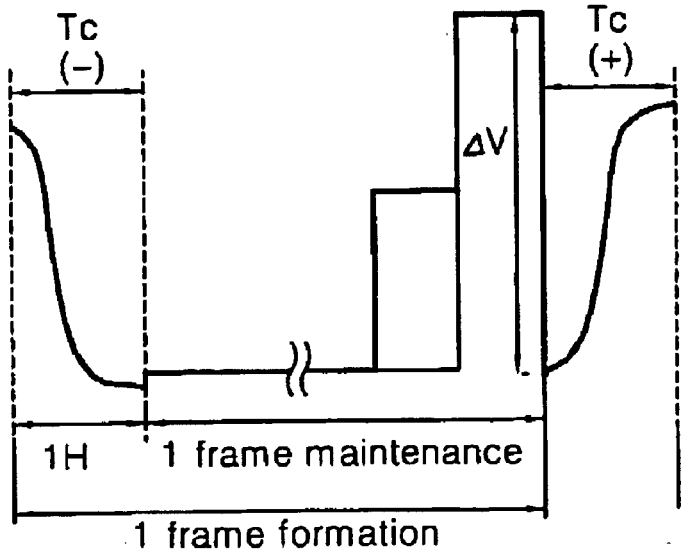

FIGS. 12 and 13 are waveform diagrams showing a time-based change with respect to data voltage charged on the storage capacitor Cst.

In FIG. 12, the storage capacitor Cst charges one of two different level positive(+) voltages from the pre-stage gate line GLn−1 during two consecutive horizontal synchronizing intervals 2H upon scanning of the gate line GLn with the aid of the dual gate start pulse DGsp and the multi-step level shifter 34, when the scanning pulse is in an ON state. In the two different level positive(+) voltages, a first-level voltage is charged to a value at least twice as large as a second-level voltage. The voltage charged in the storage capacitor Cst is sustained during one frame after a scanning pulse is turned OFF.

FIG. 13 shows an operation after one frame interval is sustained. In FIG. 13, the storage capacitor Cst charges one of two different level negative(−) voltages from the pre-stage gate line GLn−1 during two consecutive horizontal synchronizing intervals 2H upon scanning of the gate line GLn with the aid of the dual gate start pulse DGsp and the multi-step level shifter 34, when the scanning pulse has an ON state. In the two different level negative(−) voltages, a first-level voltage is charged to a value at least twice as large as a second-level voltage. The voltage charged in the storage capacitor Cst is sustained during one frame after a scanning pulse was turned ON.

Figure 14:
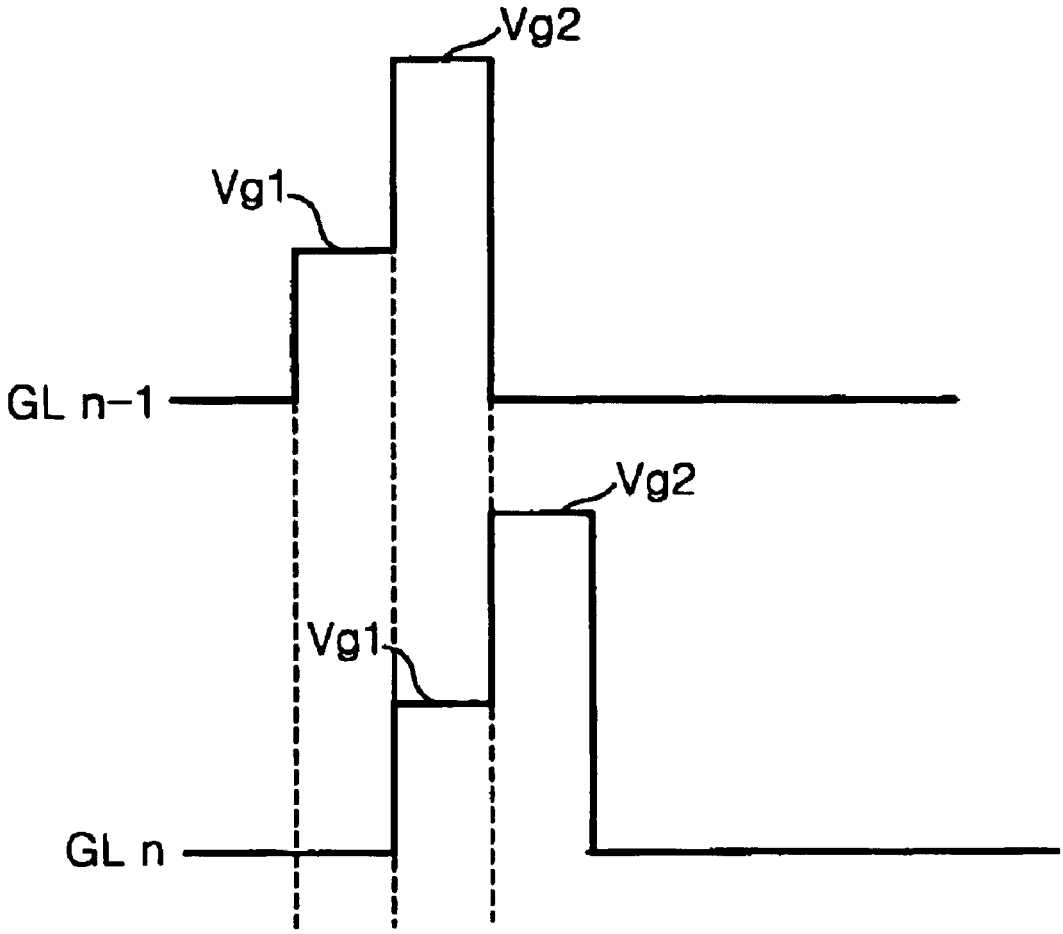
FIG. 14 is a waveform diagram of a gate voltage outputted from the gate driver shown in FIG. 11.

FIG. 14 explains sequential outputting of the waveforms of FIGS. 12 and 13 to the output terminal of the gate driver 25. In FIG. 14, the gate driver 25 sends an output signal to the gate lines GL during two consecutive horizontal synchronizing intervals 2H in response to a dual gate start pulse DGsp inputted from the controller 22. Voltage levels outputted from the gate driver 25 during two consecutive horizontal synchronizing intervals 2H are set to have different values. Upon driving, a pixel voltage charged in the pre-stage gate line GLn−1 through the storage capacitor Cst by means of the gate driver 25 precedes a pixel voltage charged in the gate line GLn through the storage capacitor Cst by one horizontal synchronizing interval 1H.

A second gate voltage Vg2 of the gate lines GL during one horizontal synchronizing interval 1H is defined as a region in which a voltage more than 20V is applied to a pixel voltage via the storage capacitor Cst. A first gate voltage Vg1 allows only a voltage for turning ON the TFT to be applied during one horizontal synchronizing interval 1H irrespective of picture quality for the purpose of canceling an affect of the gate voltage at the pre-stage gate line GLn−1 caused by the storage capacitor Cst. Accordingly, the first gate voltage Vg1 of the pixel voltage during two consecutive horizontal synchronizing interval 2H may be integral in discharging a portion of a pixel voltage charged in the storage capacitor Cst of the pre-stage gate line GLn−1, whereas the second gate voltage Vg2 may be integral to charge a pixel voltage via the storage capacitor Cst of the specific gate line GLn. Specifically, two different levels of positive(+) data voltages are charged in the pre-stage gate line GLn−1 via the storage capacitor Cst during two consecutive horizontal synchronizing intervals 2H. In the conventional art, the second gate voltage Vg2 of the pre-stage gate line GLn−1 may be more than 20V, thereby causing a distortion in a charging voltage of a pixel. Accordingly, the first gate voltage Vg1 of the pre-stage gate line GLn−1 is applied to attenuate the second gate voltage Vg2 of the pre-stage gate line GLn−2 charged with a voltage more than 20V.

In order to minimize a magnitude of a gate voltage only at a portion influenced by the pre-stage gate line GLn−1 while maintaining the gate voltage, a two-level difference of negative(−) data voltages are charged on the gate line GLn during two consecutive horizontal synchronizing intervals 2H. Pixel voltages applied to the second gate voltage Vg2 of the pre-stage gate line GLn−1, and to the first gate voltage Vg1 of the gate line GLn are superimposed during one horizontal synchronizing interval 1H. Accordingly, a voltage level of the positive(+) second gate voltage Vg2 of the pre-stage gate line GLn−1 is attenuated by the negative(−) first gate voltage Vg1 of the gate line GLn, thereby reducing variations of liquid crystal displacement angle and brightness that occur when the pre-stage gate line GLn−1 receives a data voltage of the pixel via the storage capacitor Cst.

A relationship between the first gate voltage Vg1 and the second gate voltage Vg2 can be expressed by the following equation:

$$Vg2 \geqq 2*Vg1 \quad (4)$$

In the driving method for the LCD that employs the storage capacitor Cst, a deriving voltage that allows a voltage of the pre-stage gate line GLn−1 to be stored in the storage capacitor Cst upon data charging of the storage capacitor Cst is added to a pixel voltage. In the conventional art, a deriving voltage ΔV having a relatively large value of about 10V is applied to the pixel when the gate voltage is 10V. On the other hand, according to the present invention, since the second gate voltage Vg2 of the pre-stage gate line GLn−1 may be attenuated by the first gate voltage Vg1 of the gate line GLn before it is applied through the storage capacitor Cst, the driving voltage may not be relatively large. Accordingly, an effect of the pixel voltage of the pre-stage gate line GLn−1 on the gate line GLn that is caused by the storage capacitor Cst may be reduced to less than about one-half. The driving process is repeated to all of the gate lines GL connected to the gate driver 25. Accordingly, a voltage rise resulting from an affect of a high data voltage of the pre-stage gate line GLn−1 is eliminated, thereby preventing deterioration of picture quality and generation of the flicker phenomenon.

It will be apparent to those skilled in the art that various modification and variations can be made in the liquid crystal display and driving apparatus of the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel for displaying image data corresponding to a digital video signal;

a digital video card for generating the digital video signal, a vertical synchronizing signal and a horizontal synchronizing signal;

a controller for generating a dot clock signal and a dual gate start pulse using the vertical and horizontal synchronizing signals;

a data driver for applying the digital video signal to data lines in response to the dot clock signal; and a gate driver for applying scanning signals having at least two signal voltage levels to gate lines in response to the dual gate start pulse, wherein during the application of a scanning signal to a pre-stage gate line, a subsequent scanning signal is applied to a gate line so that a voltage level of the scanning signal applied to the pre-stage gate line is attenuated by the subsequent scanning signal applied to the gate line.

2. The device according to claim 1, wherein the gate driver includes a shift register for sequentially generating scanning pulses in response to the dual gate start pulse, and a level shifter for shifting voltages of a first level of the scanning pulses from the shift register to output voltages of a second level different from the first level.

3. A method of driving a liquid crystal display including a gate driver for sequentially driving gate lines of the liquid crystal display, comprising the steps of:

sequentially generating a scanning pulse in response to a dual gate start pulse;

shifting a voltage level of the scanning pulse to a voltage level for driving the liquid crystal cell;

sequentially applying the shifted voltage level of the scanning pulse to the gate lines; and charging a pixel of the liquid crystal display with the voltage applied to the gate lines via a storage capacitor, wherein during the application of a scanning signal to a pre-stage gate line, a subsequent scanning signal is applied to a gate line so that a voltage level of the scanning signal applied to the pre-stage gate line is attenuated by the subsequent scanning signal applied to the gate line.

4. The method according to claim 3, wherein the pixel voltage is a different polarity for each gate line.

5. The method according to claim 3, wherein the shifted voltage level of the scanning pulse is applied to the gate lines during at least two consecutive horizontal period signals.

6. The method according to claim 5, wherein the voltage level of the scanning pulse has at least a two-level difference corresponding to at least a first horizontal period signal.

7. The method according to claim 6, wherein the voltage level of the scanning pulse during a second horizontal period signal is larger than the voltage level of the scanning pulse during the first horizontal period signal.

8. The method according to claim 7, wherein the voltage level of the scanning pulse during the second horizontal period signal is more than twice the voltage level of the scanning pulse during the first horizontal period signal.

9. A method of driving a liquid crystal display, comprising the steps of:

generating a scanning pulse in response to a dual gate start pulse;

shifting a voltage level of the scanning pulse to a voltage level for driving a liquid crystal cell;

applying the shifted voltage level of the scanning pulse to a plurality of gate lines; and charging a pixel of the liquid crystal display to the applied shifted voltage level via a storage capacitor, wherein during the application of a scanning signal to a pre-stage gate line, a subsequent scanning signal is applied to a gate line so that a voltage level of the scanning signal applied to the pre-stage gate line is attenuated by the subsequent scanning signal applied to the gate line.

10. The method according to claim 9, wherein the pixel voltage level is a different polarity for each of the gate lines.

11. The method according to claim 9, wherein the shifted voltage level of the scanning pulse is applied to the gate lines during two consecutive horizontal period signals.

12. The method according to claim 11, wherein the voltage level of the scanning pulse has at least two different voltage levels corresponding to at least a first horizontal period signal.

13. The method according to claim 12, wherein the voltage level of the scanning pulse during a second horizontal period signal is larger than the voltage level of the scanning pulse during the first horizontal period signal.

14. The method according to claim 13, wherein the voltage level of the scanning pulse during the second horizontal period signal is more than twice the voltage level of the scanning pulse during the first horizontal period signal.

15. A method of driving a liquid crystal display, comprising the steps of:

generating a scanning pulse;

shifting a voltage level of the scanning pulse to drive a liquid crystal cell;

applying the shifted voltage level of the scanning pulse to a plurality of gate lines; and applying the applied shifted voltage level to a pixel via a storage capacitor, wherein a voltage level of the scanning pulse during a second horizontal period signal is larger than a voltage level of the scanning pulse during a first horizontal period signal, and wherein during the application of a scanning signal to a pre-stage gate line, a subsequent scanning signal is applied to a gate line so that a voltage level of the scanning signal applied to the pre-stage gate line is attenuated by the subsequent scanning signal applied to the gate line.

16. The method according to claim 15, wherein the voltage level of the scanning pulse during the second horizontal period signal is more than twice the voltage level of the scanning pulse during the first horizontal period signal.

17. A method of driving a liquid crystal display device, comprising the steps of:

generating a digital video signal, a vertical synchronizing signal and a horizontal synchronizing signal;

generating a dot clock signal and a dual gate start pulse using the vertical and horizontal synchronizing signals;

applying the digital video signal to at least a plurality of data lines in response to the dot clock signal; and applying scanning signals having at least two signal voltage, levels to at least a plurality of gate lines in response to the dual gate start pulse, wherein during the application of a scanning signal to a pre-stage gate line, a subsequent scanning signal is applied to a gate line so that a voltage level of the scanning signal applied to the pre-stage gate line is attenuated by the subsequent scanning signal applied to the gate line.

18. The method according to claim 17, wherein the step of generating a digital video signal, a vertical synchronizing signal and a horizontal synchronizing signal includes a digital video card.

19. The method according to claim 17, wherein the step of applying the digital video signal to at least a plurality of data lines in response to the dot clock signal includes a data driver.

20. The method according to claim 17, wherein the step of applying scanning signals having at least two signal voltage levels to at least a plurality of gate lines in response to the dual gate start pulse includes a gate driver.

* * * * *